US008381383B2

(12) United States Patent
Smith et al.

(10) Patent No.: US 8,381,383 B2
(45) Date of Patent: Feb. 26, 2013

(54) METHOD FOR INSTALLATION OF GRAVITY INSTALLED ANCHOR AND MOORING ASSEMBLY

(75) Inventors: Matthew W. Smith, Houston, TX (US); John T. Shelton, III, Katy, TX (US)

(73) Assignee: Delmar Systems, Inc., Broussard, LA (US)

( * ) Notice: Subject to any disclaimer, the term of this patent is extended or adjusted under 35 U.S.C. 154(b) by 459 days.

(21) Appl. No.: 12/663,814

(22) PCT Filed: Feb. 20, 2009

(86) PCT No.: PCT/US2009/034661

§ 371 (c)(1), (2), (4) Date: Dec. 9, 2009

(87) PCT Pub. No.: WO2009/105630

PCT Pub. Date: Aug. 27, 2009

(65) Prior Publication Data

US 2011/0154636 A1 Jun. 30, 2011

Related U.S. Application Data

(60) Provisional application No. 61/029,948, filed on Feb. 20, 2008.

(51) Int. Cl.
*B23Q 3/00* (2006.01)

(52) U.S. Cl. ..... 29/464

(58) Field of Classification Search ..... 29/428, 29/464, 469, 426.1; 114/293–310, 230.1; 52/155; 405/224

See application file for complete search history.

(56) References Cited

U.S. PATENT DOCUMENTS

| | | | |
|---|---|---|---|
| 5,915,326 | A | 6/1999 | Karal |
| 6,941,885 | B2 | 9/2005 | Zimmerman et al. |
| 7,059,263 | B1 | 6/2006 | Zimmerman |
| 7,117,812 | B2 | 10/2006 | Zimmerman et al. |
| 2005/0166825 | A1 | 8/2005 | Zimmerman et al. |
| 2006/0092034 | A1 | 5/2006 | Worthy et al. |
| 2006/0107886 | A1 | 5/2006 | Zimmerman |

*Primary Examiner* — John C Hong

(74) *Attorney, Agent, or Firm* — Law Office of Jesse D. Lambert, LLC

(57) ABSTRACT

Apparatus and method of placement of gravity installed anchors in offshore environments, for the mooring of structures thereto In the preferred embodiment, a gravity installed anchor has an outwardly extending load arm, which is preferably rotatable around the longitudinal axis of the anchor A load line is attached to the load arm, and a subsea connector is attached to the distal end of the load line The subsea connector is held in a staging device, which rests on the seabed and supports the subsea connector in a desired position to facilitate subsea connection thereto A deployment/recovery line is attached to the rearward end of the gravity installed anchor This gravity installed anchor and mooring assembly is lowered from the installation vessel on a lowering line, by a release hook on the end of the lowering line engaging the deployment/recovery line.

24 Claims, 17 Drawing Sheets

METHOD FOR INSTALLATION OF GRAVITY INSTALLED ANCHOR AND MOORING ASSEMBLY

CROSS REFERENCE TO EXISTING APPLICATIONS

This regular patent application claims priority to U.S. Provisional Patent Application Ser. No. 61/029,948, filed Feb. 20, 2008, for all purposes.

BACKGROUND

1. Field of the Invention

This invention relates generally to apparatus used in connection with the mooring of structures in offshore environments, and related methods of use. More specifically, this invention relates to a particular method for installation of a gravity installed anchor in a seabed and placement of a mooring assembly connected thereto, for connection of the anchor to a structure to be moored, and for later retrieval of the anchor, and to apparatus to carry out the method.

2. Description of the Related Art

This invention is directed toward a method for installation of a gravity installed anchor in a seabed and placement of a connected mooring assembly; connection of the anchor to a floating or submerged structure; and disconnection therefrom and retrieval of the gravity installed anchor from the seabed when no longer in use. Apparatus used in the method are also encompassed within the scope of the invention.

It is well known in the relevant art that various anchors are used to fix structures in place, in an offshore environment. Frequently, floating structures are fixed in place; for example, floating drilling rigs, production facilities, processing facilities, barges, work vessels, etc. In addition, mooring may be required for non-floating structures, such as pile-type structures which may be, to some greater or lesser degree, supported by the seabed, but which still require mooring.

It is also well known that various types of anchors are used to fix one end of a line to the seabed, such as dead weight anchors, clump anchors, embedment anchors, vertically loaded anchors, and a number of other designs.

The term "gravity installed anchor," as used in this application, is used to refer to an anchor which achieves some degree of embedment in a seabed by virtue of a free fall (through the water) from a desired distance above the seabed, whereby the anchor penetrates a distance into the seabed. Such anchors can be used to moor floating structures, or to provide a fixing point for submerged structures. It is understood that the term "gravity installed anchor" is used broadly herein, and encompasses all types of anchors which can be installed into the seabed by virtue of a freefall through a water column, to and into the seabed.

In many mooring situations, it is desired to place the gravity installed anchor with a mooring line section or load line (e.g. a length of cable) already attached, said load line laid out on the seabed in the ultimate direction of the structure being moored (that is, substantially aligned with a line between the anchor location and the structure being moored), and, in some situations, with a subsea connector attached to the end of the load line distal from the gravity installed anchor. The present invention provides an efficient method of so placing a gravity installed anchor and a mooring assembly, and of its retrieval after use. In other applications, the gravity installed anchor may be installed with the entire mooring line attached, and with or without a subsea connector; in such applications, the end of the mooring line distal from the anchor (which may be laying on the seabed, or floating with a buoy) is picked up and connected to the structure being moored.

SUMMARY OF THE INVENTION

The present invention broadly comprises a method of installing a gravity installed anchor along with some length of line attached, for ultimate connection to a structure being moored. More specifically, the present invention comprises a method of installing a gravity installed anchor along with its related mooring assembly, connecting said gravity installed anchor to a floating or subsea structure to be moored, and of disconnecting the gravity installed anchor from the moored structure and retrieving the anchor to the surface, along with related apparatus. A gravity installed anchor (preferably with a deployment/recovery line attached to its upper end) is lowered into the water from an installation vessel, on a single line comprising a release means (e.g. a release hook). The gravity installed anchor, in a presently preferred embodiment, comprises a load arm, to which is attached a load line (typically, a relatively short length of flexible member, such as a cable). A subsea connector is attached to the distal end of the load line; the subsea connector is held in a position which facilitates subsea connection/disconnection, for example held in a staging device (a structure resting on the seabed).

The described assembly is lowered through the water toward the seabed until the staging device rests on the seabed. The installation vessel then moves in a direction aligned with the ultimate direction of mooring pull, releasing line so as to enable the load line to lie on the seabed along the path of mooring pull, and, in addition, to rotate the anchor and/or load arm to a position aligned with the path of mooring pull. The installation vessel continues movement to a location whereby the gravity installed anchor is suspended over the desired penetration point, at a desired distance above the seabed. The release means is actuated, freeing the gravity installed anchor to fall to and into the seabed. A mooring line from the structure being moored, with a subsea connector connected thereto, is then connected to the subsea connector on the load line.

After use of the gravity installed anchor is complete, the subsea connectors are disconnected; and the anchor is retrieved by pulling it from its embedment, for example by a retrieval hook lowered to connect to the deployment/recovery line; and the assembly (gravity installed anchor, load line, staging device, and subsea connector) is brought back to the surface.

DETAILED DESCRIPTION OF THE PREFERRED EMBODIMENT

With reference to the attached drawings, a presently preferred embodiment and various alternative embodiments of the invention will now be described.

Figure 1:
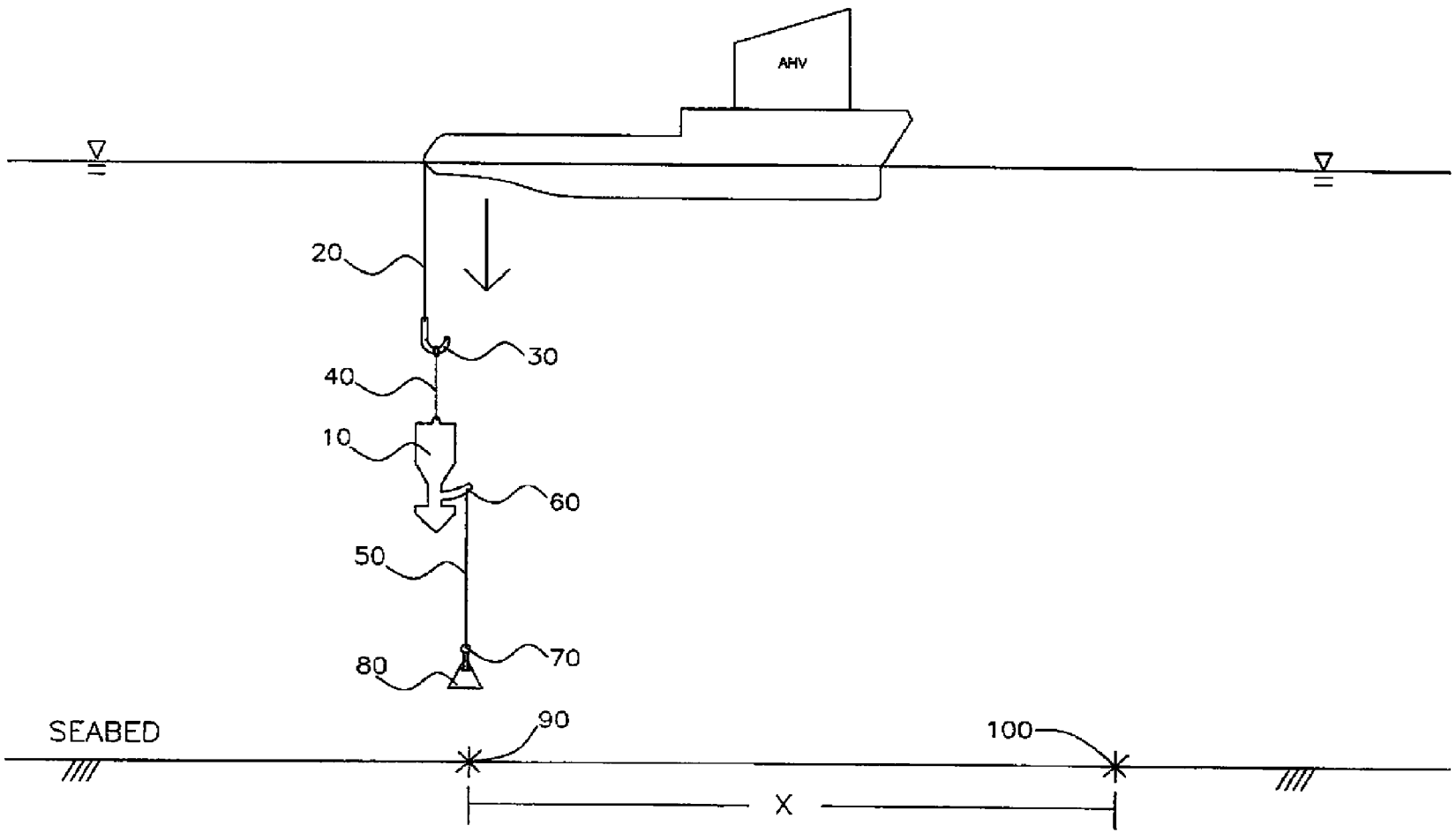
FIGS. 1-5 show a sequence of steps of the method of the present invention, illustrating the various components of the apparatus involved in the installation process.

FIG. 1 shows a gravity installed anchor 10 being lowered with a single lowering line 20 from an installation vessel (denoted as "AHV" in the drawings). Various types of installation vessels are suitable for deploying or installing the anchor and mooring assembly. Gravity installed anchor 10 has a longitudinal axis, and may comprise anchor designs of different types, known in the art. A release hook 30 is attached to the end of lowering line 20. A deployment/recovery line 40 connects gravity installed anchor 10 to release hook 30, with deployment/recovery line 40 attached to the upper end (as the gravity installed anchor is aligned in the drawing, which is the end of the anchor opposite the nose of the anchor) of gravity installed anchor 10. In the presently preferred embodiment, gravity installed anchor 10 comprises a load arm (described further below). A line, which may be a full mooring line or a shorter line, such as load line 50, is connected to gravity installed anchor 10 by a means for connecting load line 50, which may comprise a load arm 60 (described below). Load line 50 is suspended from load arm 60, and load line 50 hangs below gravity installed anchor 10 during the lowering process. It is understood that references herein to "line" and "rope" refer generally to flexible, load carrying members, whether steel cable, synthetic cable, rope, chain, or any other flexible load carrying members.

Figure 8:
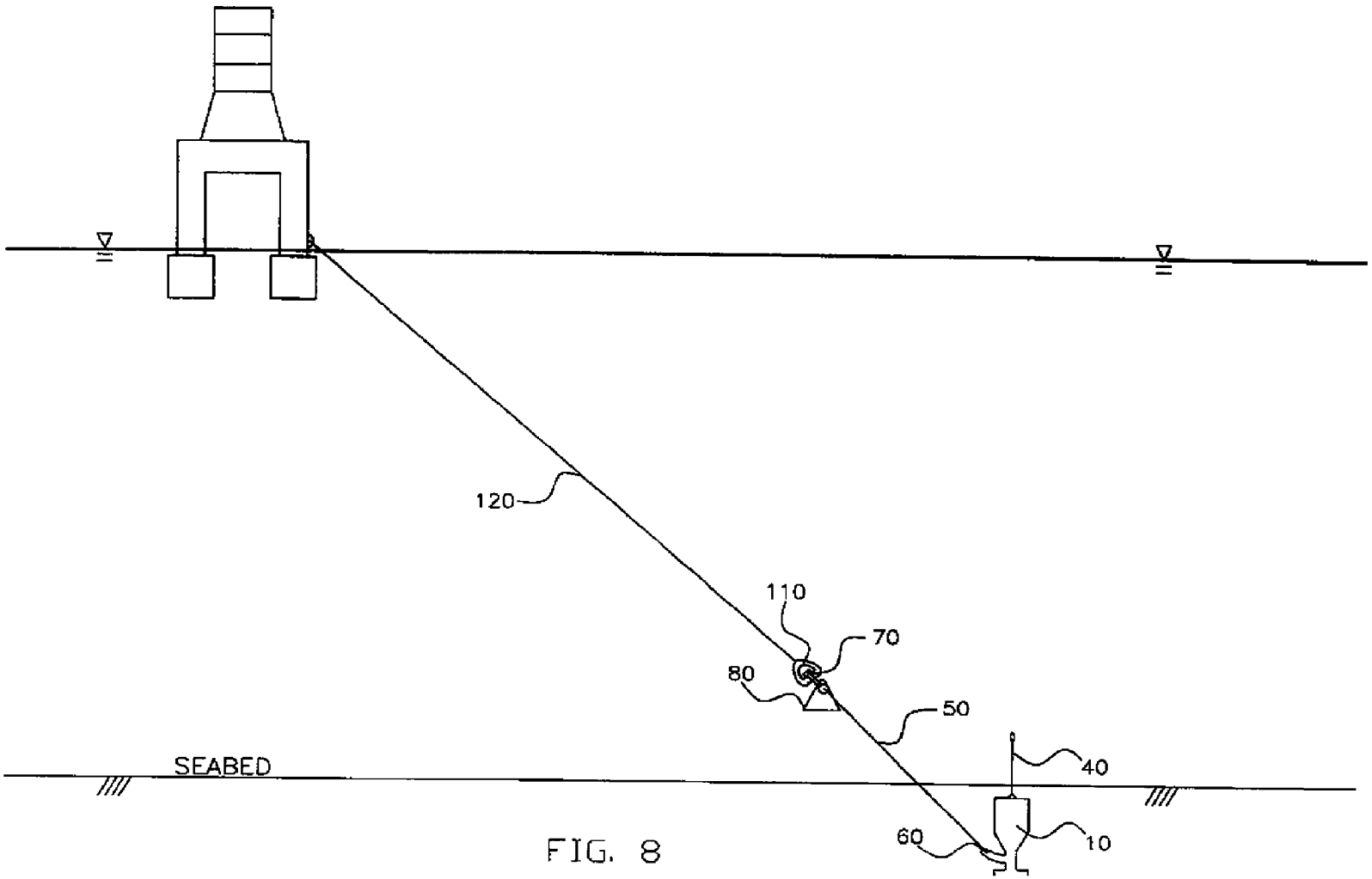

In a presently preferred embodiment, means for connecting load line 50 to gravity installed anchor 10 comprises a load arm 60. Load arm 60 is attached to gravity installed anchor 10 at a location along the length of anchor 10, and in the preferred embodiment extends outwardly from the longitudinal axis (i.e. displaced outwardly therefrom). Preferably, load arm 60 is attached to gravity installed anchor 10 in such manner that load arm 60 has the ability to rotate 360° around the longitudinal axis of gravity installed anchor 10, independent of rotation of gravity installed anchor 10. A subsea connector 70 is connected to load line 50, at the opposite end of load line 50 from gravity installed anchor 10. Preferably, a means for holding subsea connector 70 in a desired position on the seabed is provided, which may be a staging device 80. As can be seen in the figures, staging device 80 holds subsea connector 70 in a position to facilitate subsea connection of connector 70 with the mooring line of a moored structure (as is later described, particularly with reference to FIG. 8, showing mooring line 120).

It is to be understood that in other embodiments of this invention, other means for connecting a line, which may be load line 50, to gravity installed anchor 10 are provided. In such embodiments, gravity installed anchor 10 does not comprise an outwardly (from the longitudinal axis of the anchor) extending load arm as described above (or one extending any significant distance from the longitudinal axis of the anchor), but has other structure connecting load line 50 or another line (e.g. a mooring line) to gravity installed anchor 10. These alternative embodiments include:

1. gravity installed anchor 10 having a shank to which a line, for example load line 50 (or a mooring line) is connected.
2. load arm 60 is replaced with a load ring or shackle, closely encircling gravity installed anchor 10, to which load line 50 is connected; or
3. load line 50 is attached to gravity installed anchor 10 by a side or end attachment.

Other embodiments of gravity installed anchor 10 are encompassed within the scope of the invention.

FIG. 1 shows the gravity installed anchor and mooring assembly being lowered toward the seabed, in particular staging device 80 being lowered to the proposed staging device touchdown location 90 on the seabed. Staging device 80 touchdown location 90 is a pre-determined distance (denoted in the figure as "X") from the proposed anchor drop location 100. The magnitude of distance "X" depends on different design variables, including the length and rigging configuration of load line 50 and the drop height "Y" (see FIG. 3) for gravity installed anchor 10. Drop height "Y" is the height above the seabed from which gravity installed anchor 10 will be dropped, and can be adjusted for the desired depth of penetration of gravity installed anchor 10 into the seabed for different soil and loading conditions.

Figure 2:
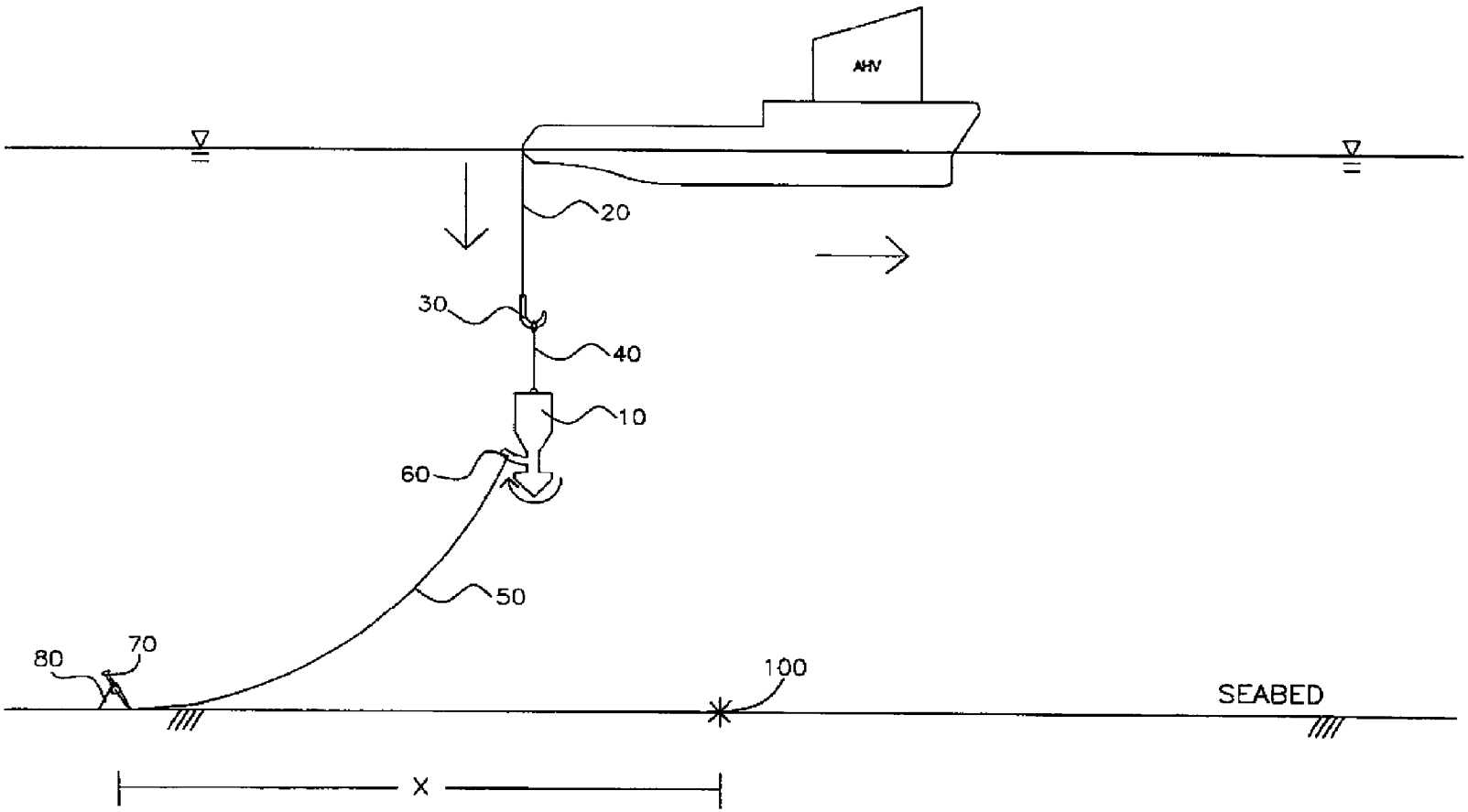
Figure 3:
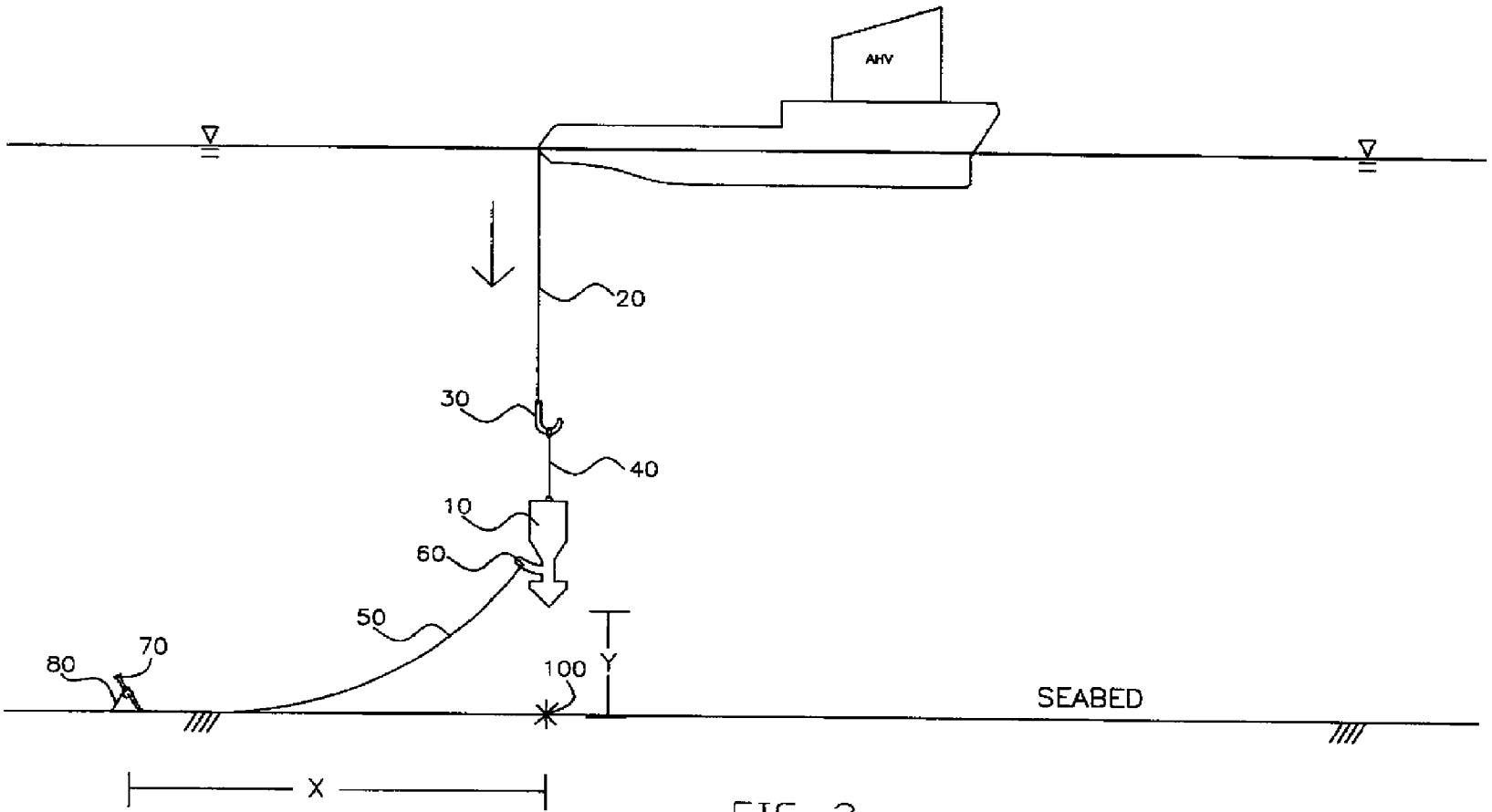

FIG. 2 shows staging device 80 in place on the seabed. After staging device 80 touches down on the seabed, the installation vessel (denoted in the figures as "AHV") begins movement toward the proposed anchor drop location 100. The installation vessel also simultaneously pays out lowering line 20. The vessel movement continues until gravity installed anchor 10 is directly over the proposed anchor drop location 100 (FIG. 3). Lowering line 20 is continued to be paid out until gravity installed anchor 10 is at the correct drop height, denoted as "Y" in FIG. 3. As anchor 10 is moved towards the proposed drop location 100, the means for connecting load line 50 to gravity installed anchor 10 (which may be load arm 60), and/or gravity installed anchor 10, rotates about the longitudinal axis of gravity installed anchor 10 in response to a pull from load line 50 (which results from friction between load line 50 and the seabed, and/or tension resulting from pull exerted by staging device 80). It can be readily seen that this rotation of the means for connecting load line 50 (for example, load arm 60) aligns said means for connecting load line 50 (e.g. load arm 60) and/or the connection point of load line 50 to gravity installed anchor 10, with the ultimate direction of mooring pull. This movement also lays load line 50 (or a mooring line, as is later described) along a line from the anchor drop location to the structure being moored.

Figure 4:
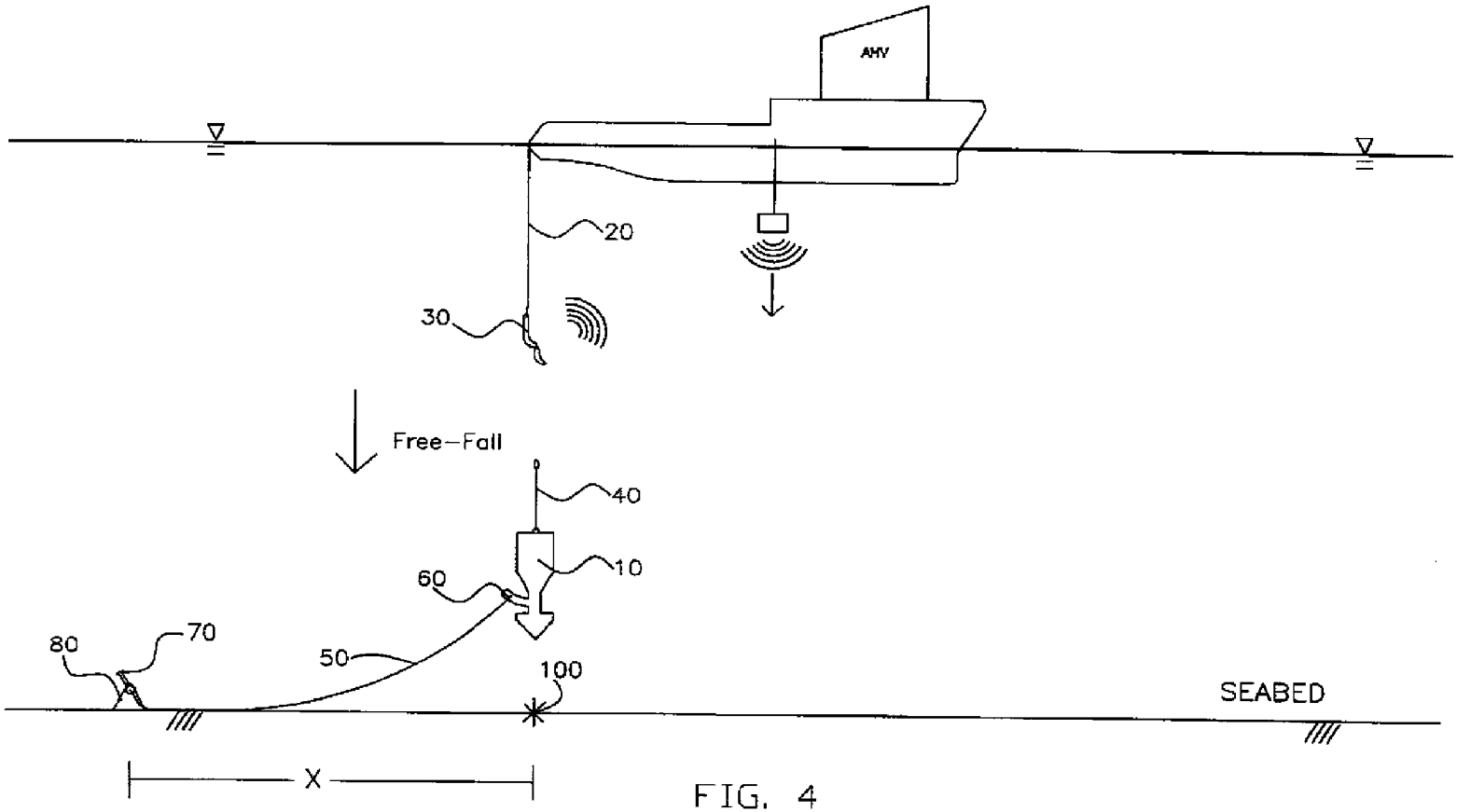
Figure 5:
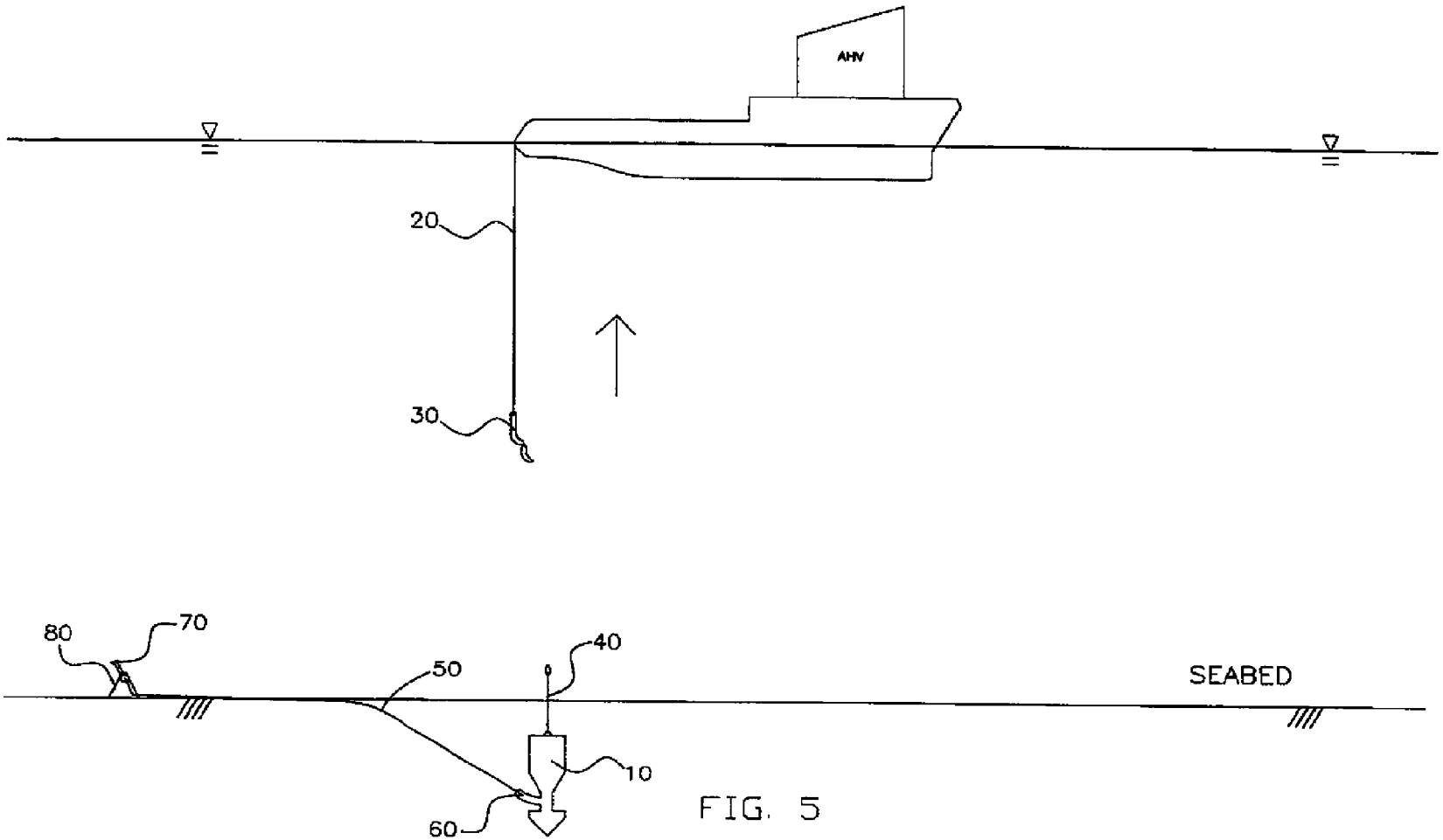

FIG. 4 shows release hook 30 triggered and gravity installed anchor 10 free-falling toward the seabed. Release hook 30 may be released by various means known in the art, including but not limited to acoustic means, mechanical means, an additional line, or subsea Remotely Operated Vehicle ("ROV") intervention (the ROV launched from the AHV from which the anchor was deployed, or from another vessel). FIG. 4 shows release hook 30 in the opened (i.e. triggered) position. Once released, gravity installed anchor 10 free-falls from the drop height "Y" and penetrates into the seabed under the force of gravity. FIG. 5 shows gravity installed anchor 10 in its position, fully penetrated into the seabed. Staging device 80 remains in place on the seabed when gravity installed anchor 10 penetrates into the seabed. Deployment/recovery line 40 may be buoyant, so as to remain substantially vertical in the water, and/or may have visual markings along its length to enable verification of the depth of penetration of gravity installed anchor 10 (for example, by viewing with an ROV-carried subsea camera). After gravity installed anchor 10 is released from lowering line 20, the vessel can haul in on lowering line 20 and recover release hook 30 as shown in FIG. 5.

Figure 6:
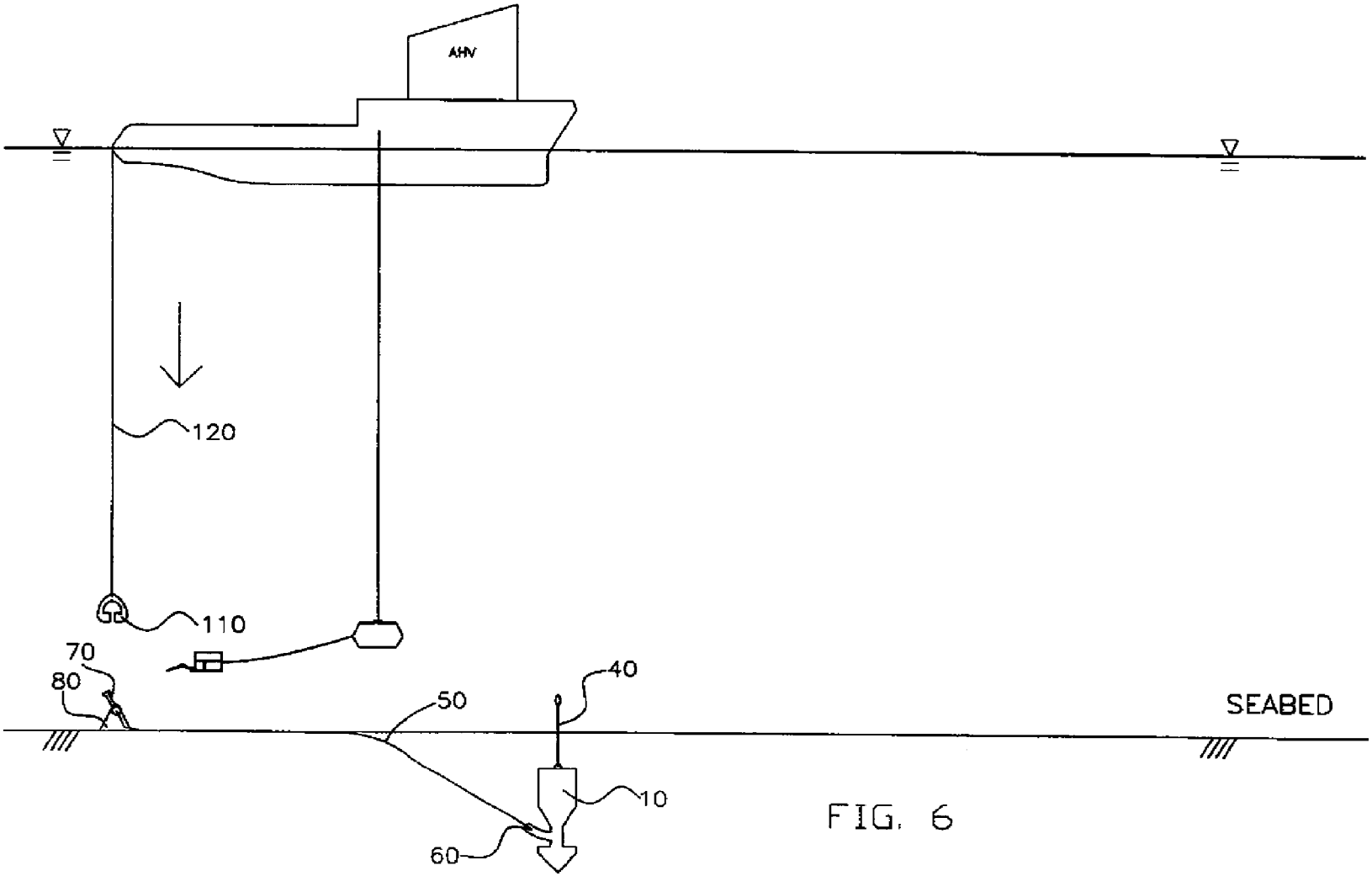
FIGS. 6-8 show a sequence of steps of attaching a floating structure to the anchor.
Figure 7:
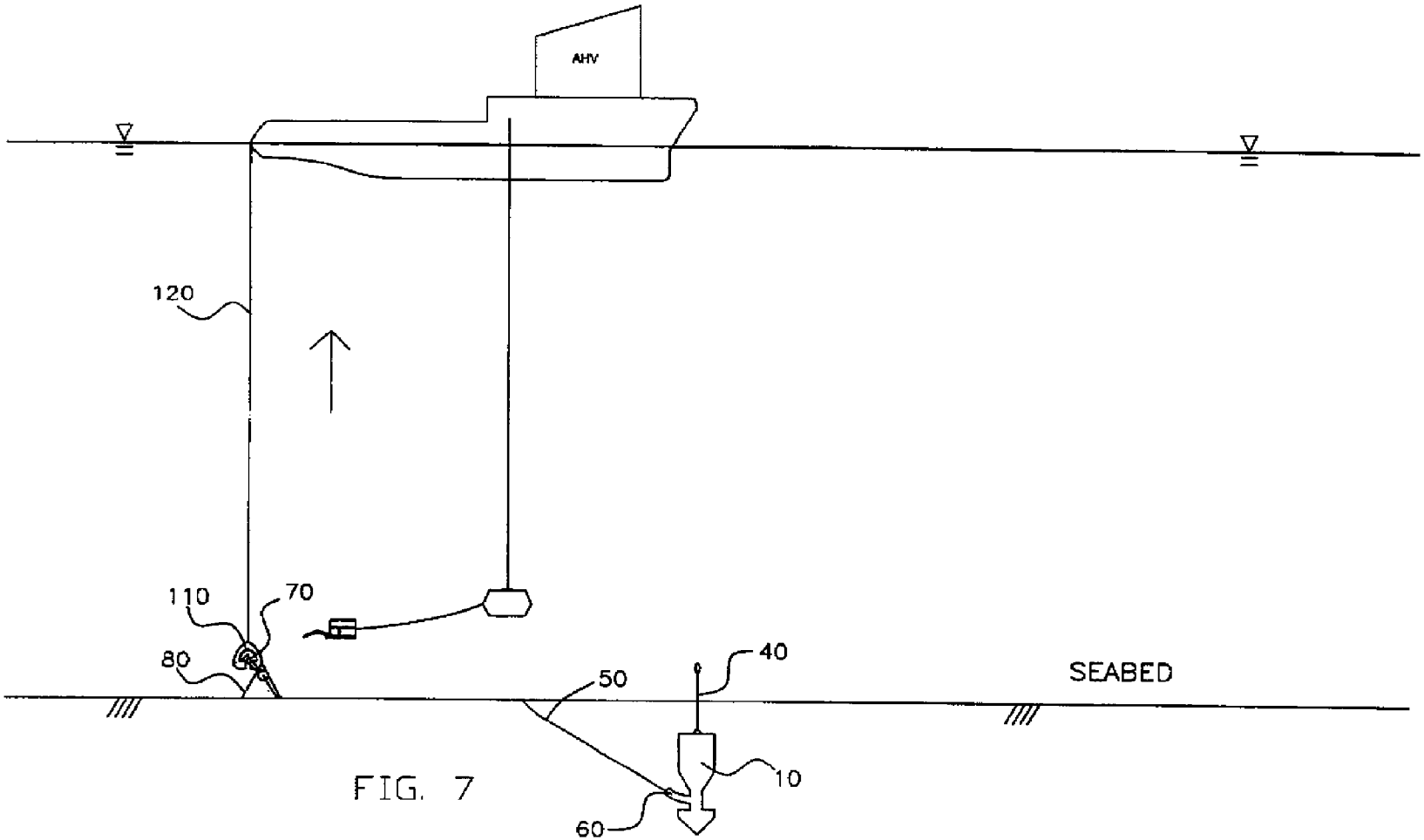

The next step in the method of the present invention is connection of a structure to gravity installed anchor 10. As previously stated, gravity installed anchor 10 may be used to moor a floating structure (drilling rig, production facility, etc.), or a non-floating subsea structure (that is, one which is supported in whole or part by contact with the seabed). FIG. 6 shows an installation vessel deploying a subsea connector 110 suspended from a mooring line 120. Subsea connector 110 on the mooring line is lowered and connected to the subsea connector 70 on the load line, typically with ROV assistance. Once subsea connectors 110 and 70 are connected, the installation vessel deploys mooring line 120 and performs mooring line connection to connect to a structure as shown in FIGS. 7-8, by methods known in the art.

Figure 9:
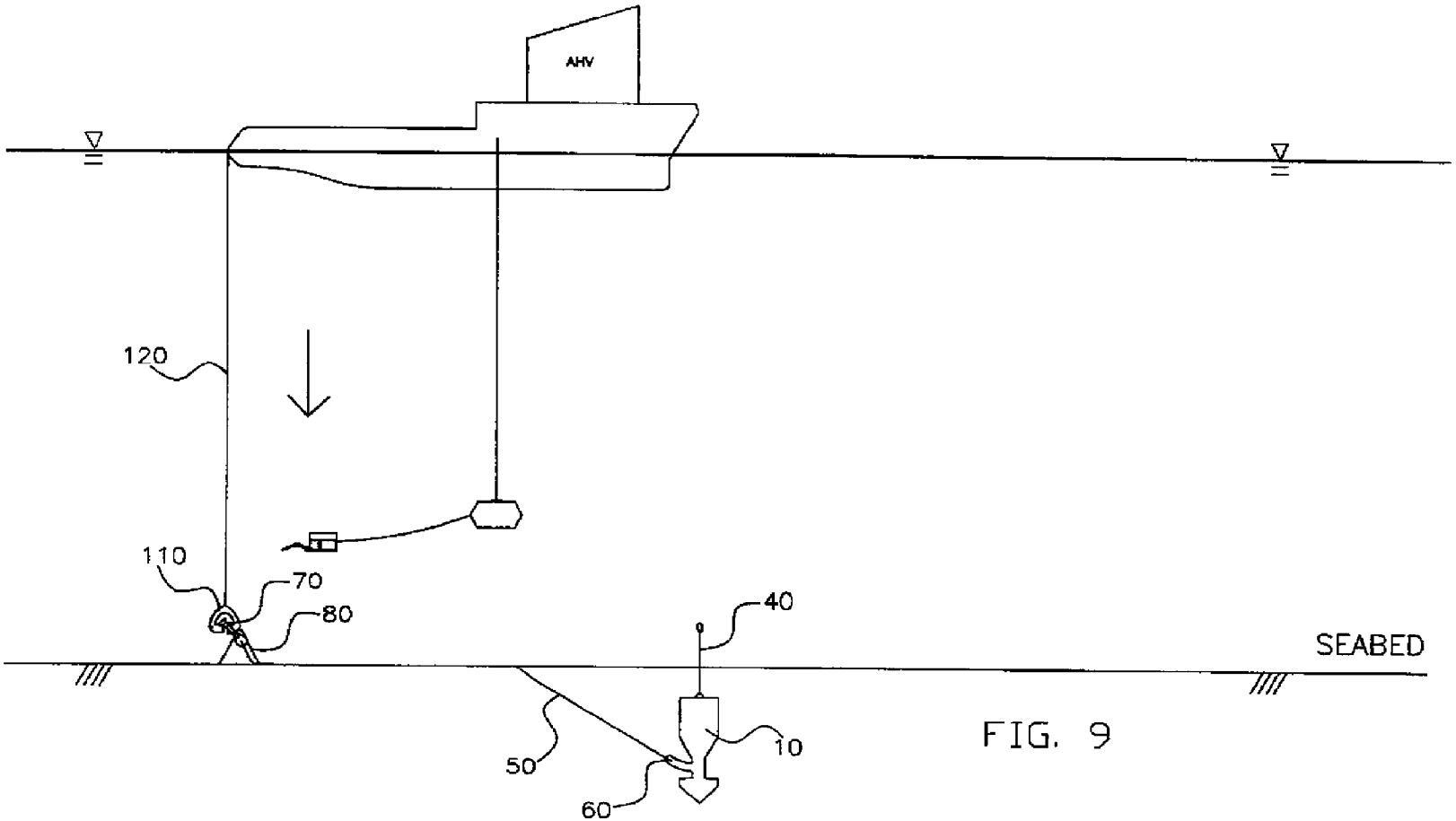
FIGS. 9-10 show a process of disconnecting a floating structure from the anchor.
Figure 10:
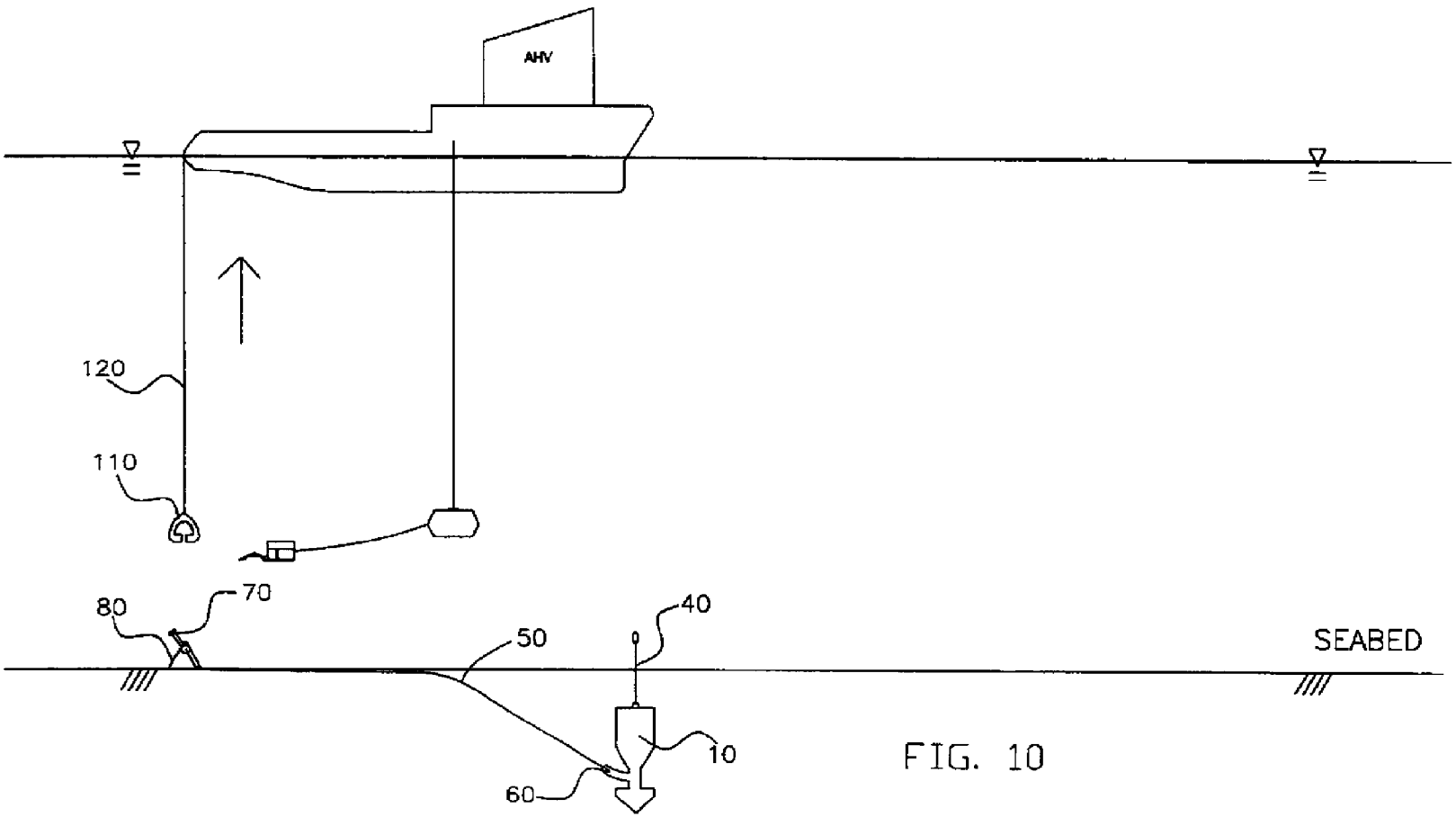

To disconnect gravity installed anchor 10 from a floating structure, as shown in FIGS. 8-9, after performing mooring line disconnection by methods known in the art, the installation vessel lowers subsea connectors 70, 110 suspended from mooring line 120, typically until staging device 80 touches down on the seabed. Once staging device 80 touches down on the seabed, the ROV can manipulate the subsea connectors to disconnect. Once subsea connectors 70, 110 are disconnected, the vessel recovers mooring line 120 and subsea connector 110, as shown in FIG. 10.

Figure 11:
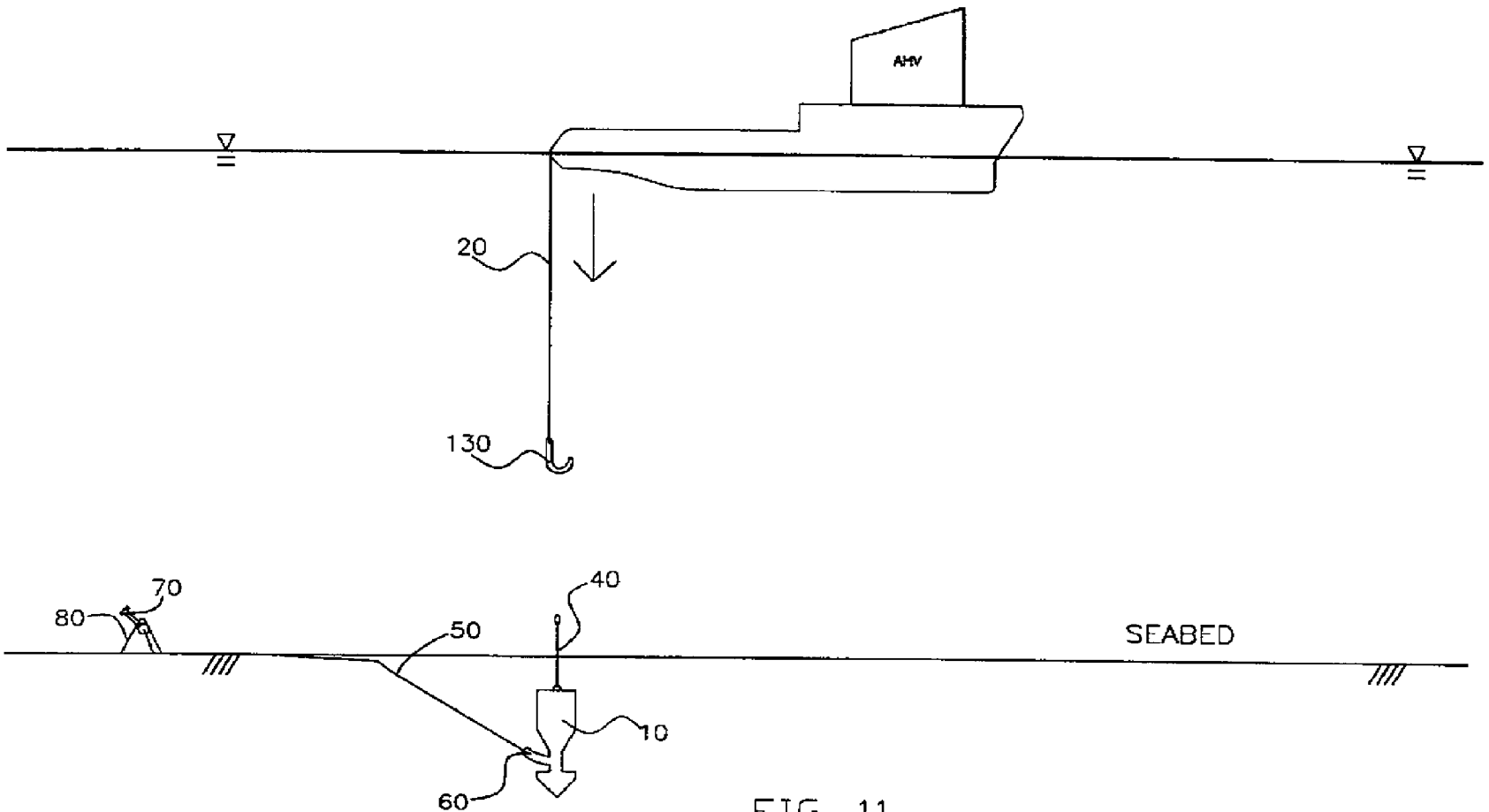
FIGS. 11-14 show a sequence of steps of the method of recovering the anchor, illustrating various components involved in the recovery process.
Figure 12:
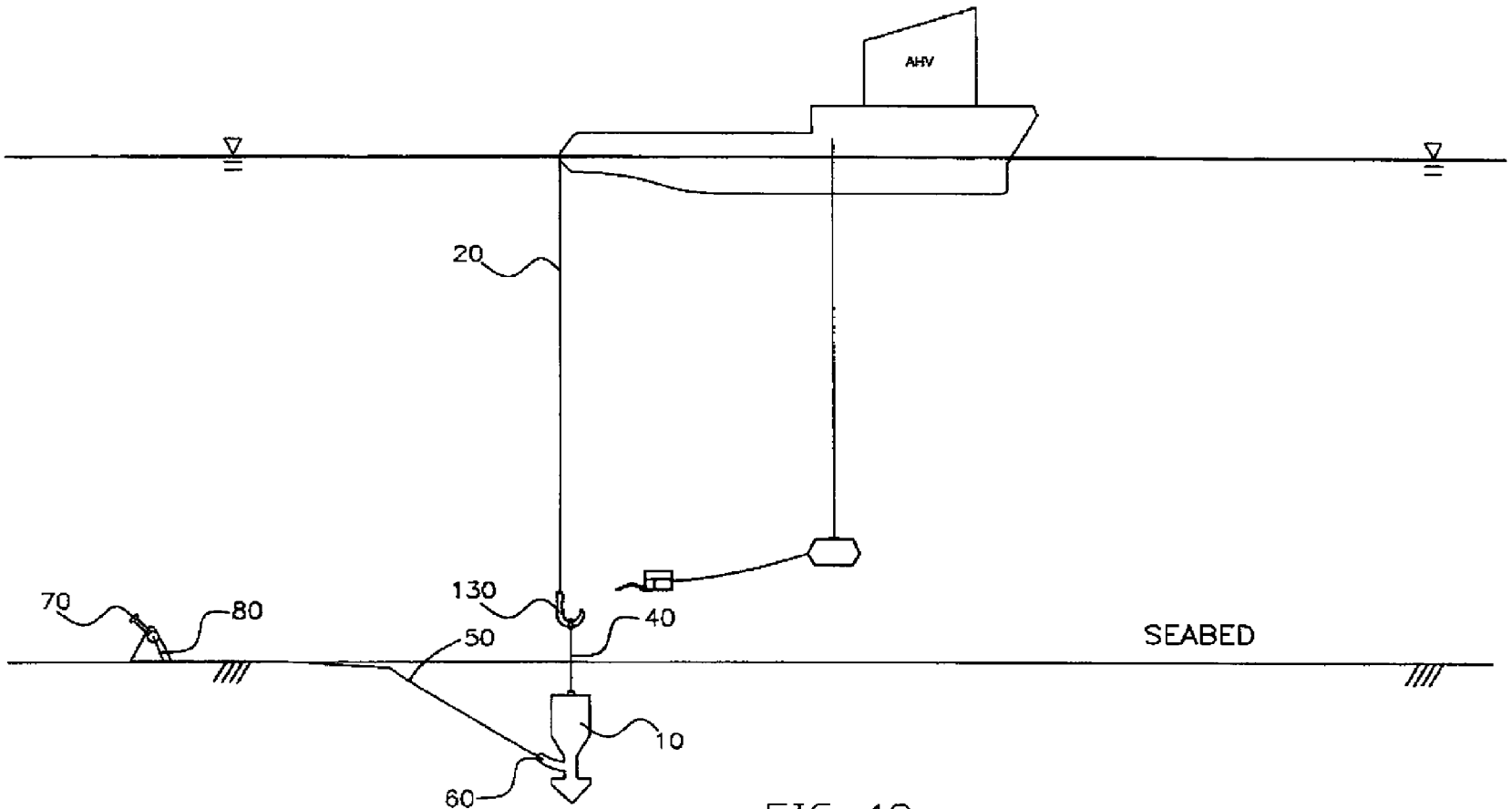
Figure 13:
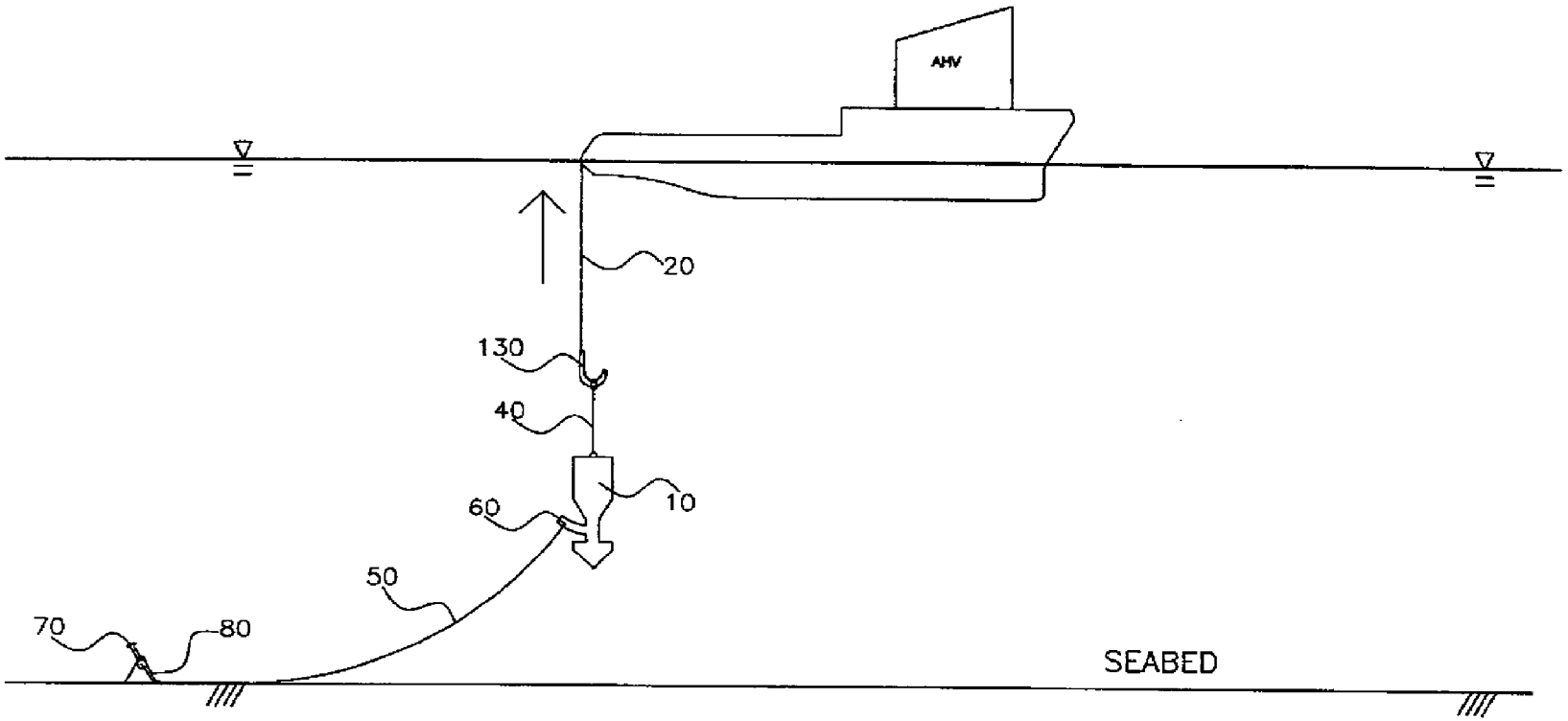
Figure 14:
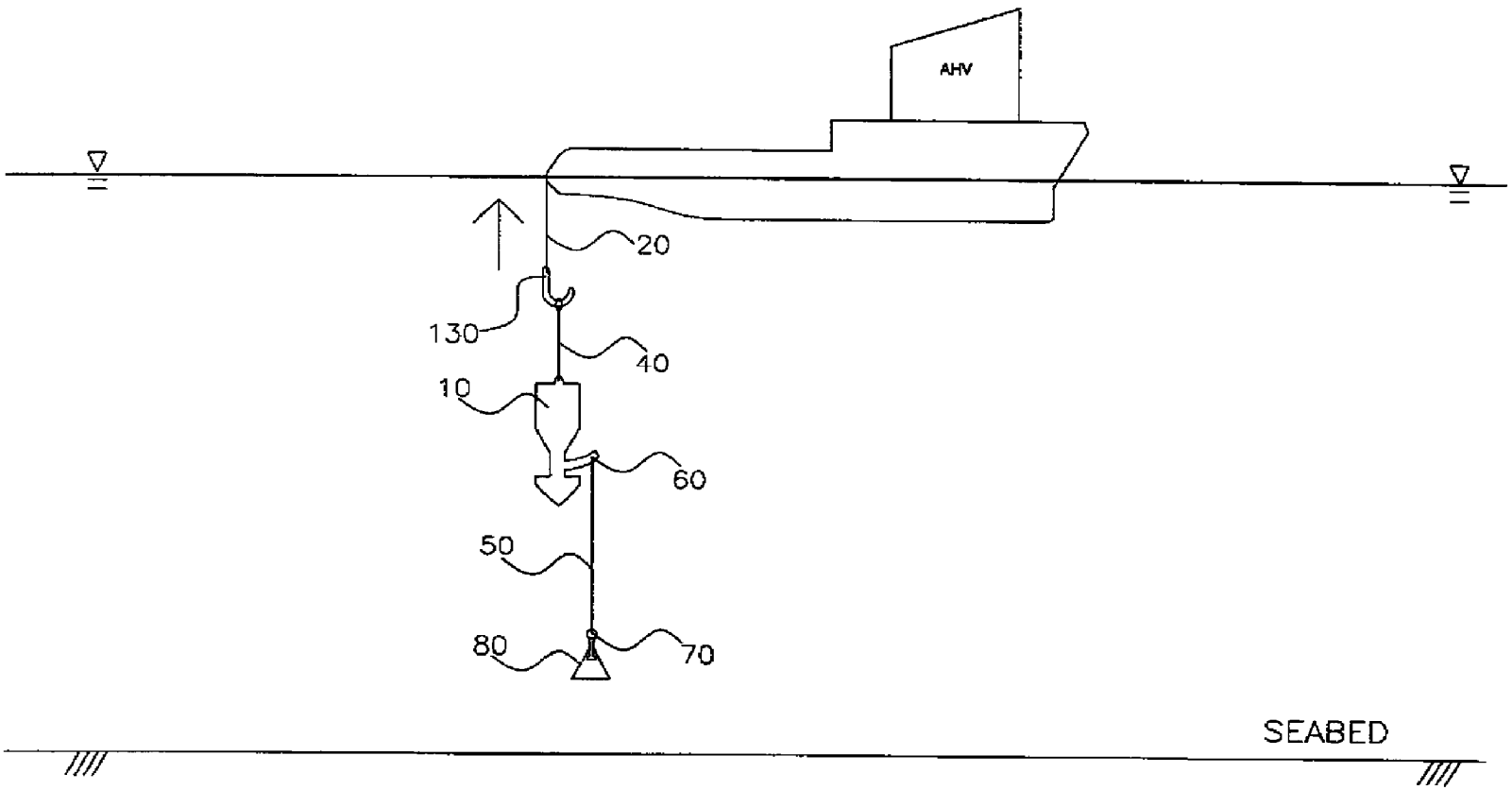

To recover gravity installed anchor 10 from the seabed, gravity installed anchor 10 is pulled from its embedded position in the seabed. A preferred embodiment of this procedure is as follows: an installation vessel deploys a recovery hook 130 suspended from lowering line 20, as shown in FIG. 11. An ROV guides an opening, for example a floating open eye located on the uppermost end of deployment/recovery line 40, onto recovery hook 130, as can be seen in FIG. 12. In FIG. 13, the installation vessel hauls in on lowering line 20, thereby lifting gravity installed anchor 10 from its embedded position in the seabed. The installation vessel continues hauling in on lowering line 20 in FIG. 14 to bring the assembly onto the vessel (including gravity installed anchor 10, load line 50, subsea connector 70, and staging device 80).

Other Embodiments Falling Within the Scope of the Present Invention

While the foregoing description is set forth in some detail, in order to illustrate and fully disclose one or more embodiments of the present invention, it is to be understood that the description is illustrative and not limiting. The following are several points which should be noted in conjunction with the description:

1. The anchor deployment and recovery vessel, herein referred to as installation vessel, may be an anchor handling vessel (AHV), or any single vessel capable of carrying out the installation and recovery method.
2. The lowering line 20 (which also serves as deployment/recovery line) is a single line between the installation vessel and gravity installed anchor 10. As mentioned below, in one embodiment of the invention, lowering line 20 remains attached to the installation vessel, for attachment of a buoy.
3. The release of gravity installed anchor 10 may be via various means, including the use of a release hook 30, which can be triggered or opened in various ways: via acoustic or mechanical means, or triggered by other methods by means of the installation vessel, a separate vessel or marine structure, or an ROV.
4. The means for holding subsea connector in a desired position may comprise a staging device 80, which may comprise a mudmat, stand, or a suspension buoy which holds subsea connector 110 in a position which facilitates subsea connection and disconnection of load line 50 from a mooring line or lowering line.
5. In the preferred embodiment, placement of staging device 80 and subsequent installation vessel movement to proposed anchor drop location 100 pre-aligns the means for connecting line (e.g. load line 50) to anchor 10, for example load arm 60 (or orients anchor 10), to the desired alignment, said desired alignment most commonly being the direction of proposed mooring line pull, prior to free-fall into the seabed and connection to a structure. At the same time, load line 50 and/or mooring line 120 is laid along a line between the anchor location and the structure being moored.
6. The penetration depth of gravity installed anchor 10 into the seabed can be visually verified by depth penetration markings along the length of a recovery line 40 attached to the uppermost end of gravity installed anchor 10, which is especially eased when said recovery line is buoyant and floating in a substantially upright position. Alternatively, penetration depth may be determined by lifting a non-buoyant recovery line 40 to determine the length remaining above the seabed, thereby permitting determination of the depth of penetration of gravity installed anchor 10.
7. The structure attached to gravity installed anchor 10 using the disclosed installation method can be a buoyant marine structure (floating at the water surface), or a subsea structure under the surface of the water, including on the seabed.

Figure 15:
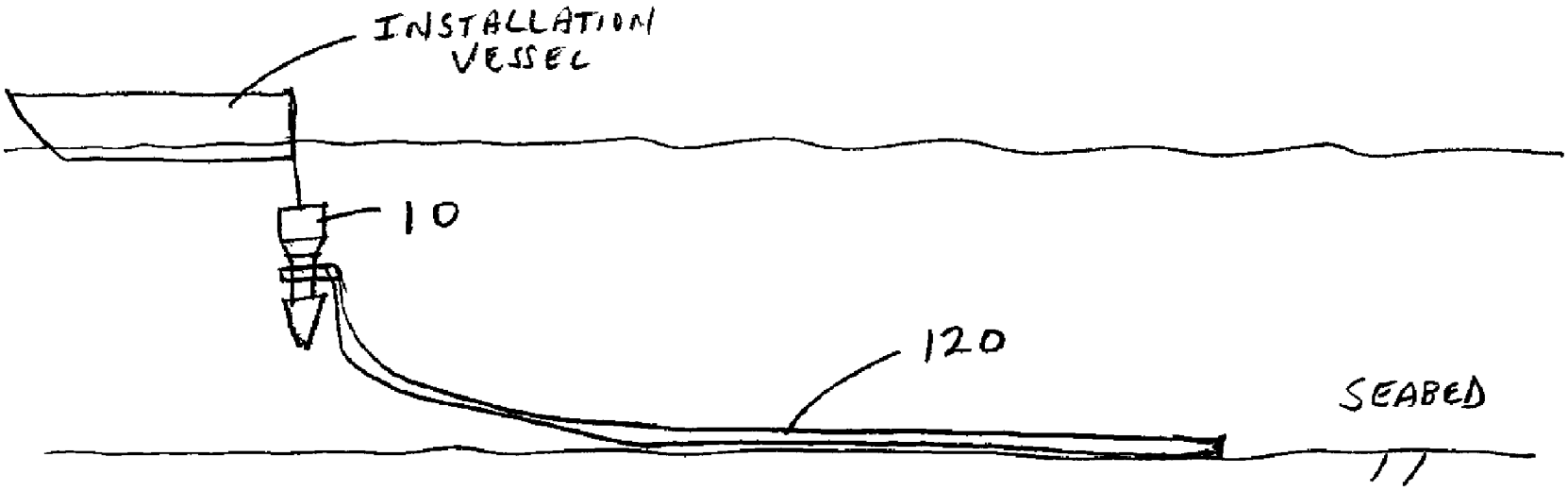
FIG. 15 shows an embodiment in which the entire mooring line (rather than a load line) is attached to the gravity installed anchor, when same is installed.

Yet other methods of installing a gravity installed anchor are contemplated within the scope of this invention. For example, with reference to FIG. 15, gravity installed anchor 10 may be connected to mooring line 120 by a means for connecting a line to said gravity installed anchor, without a load line 50 as previously described. Mooring line 120 may, but does not necessarily, have a subsea connector 70 on the end distal from gravity installed anchor 10. This distal end of mooring line 20 is put in a desired location, either on or near the sea bed, or suspended by a buoy. The installation vessel then pays out mooring line 120 and moves so as to position gravity installed anchor 10 in a desired location. Gravity installed anchor 10 is then lowered to a desired height above the seabed and released. The distal end of mooring line 120 is then secured and connected to the structure being moored by methods known in the art.

Figure 16:
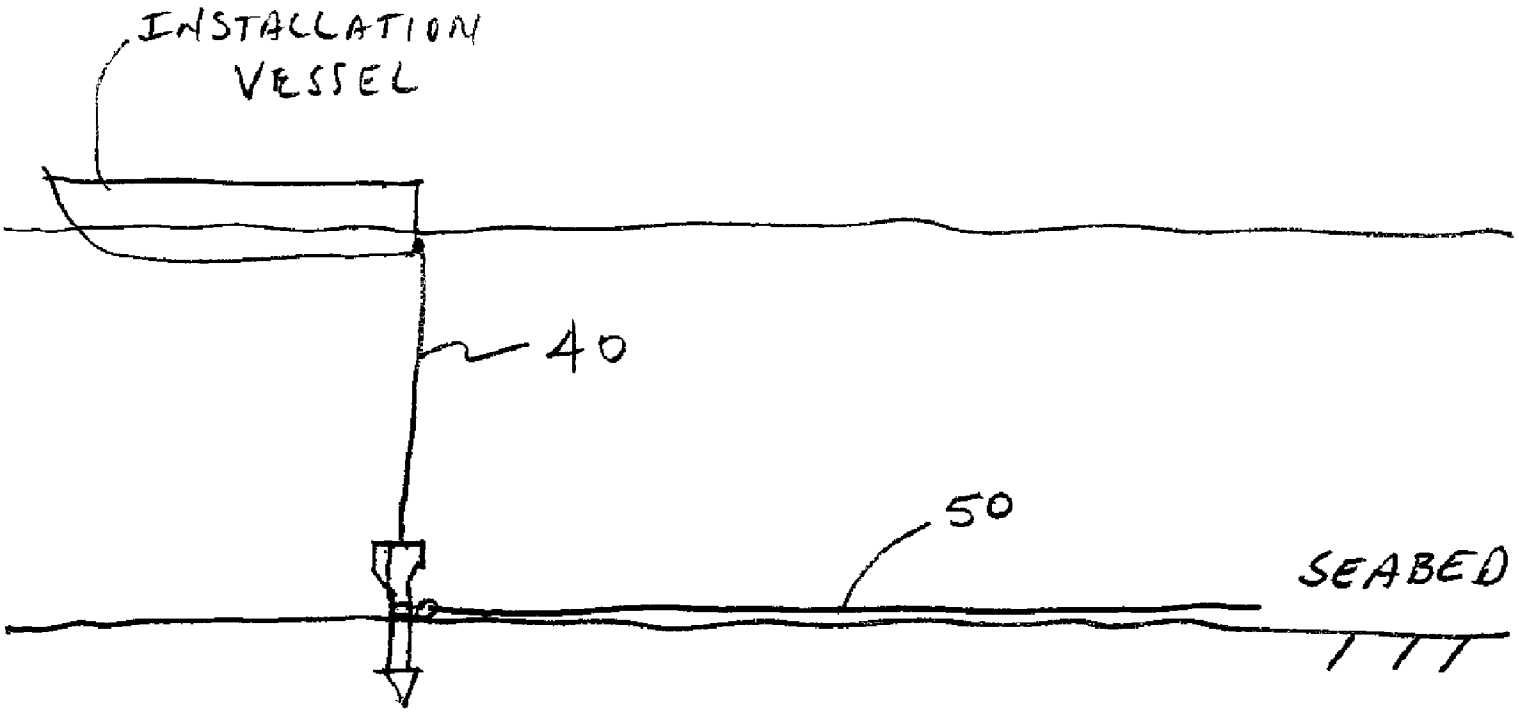
FIG. 16 shows an alternative embodiment wherein the deployment/recovery line remains attached to the installation vessel when the anchor is deployed (i.e. said line is long enough to span the water depth), for attachment of a buoy thereto if desired.

Another method of deploying gravity installed anchor 10 (see FIG. 16) maintains a line, for example deployment/recovery line 40, secured between the installation vessel and said anchor, even when gravity installed anchor 10 is dropped. A buoy can then be attached to this line, for later retrieval of the anchor.

Figure 17:
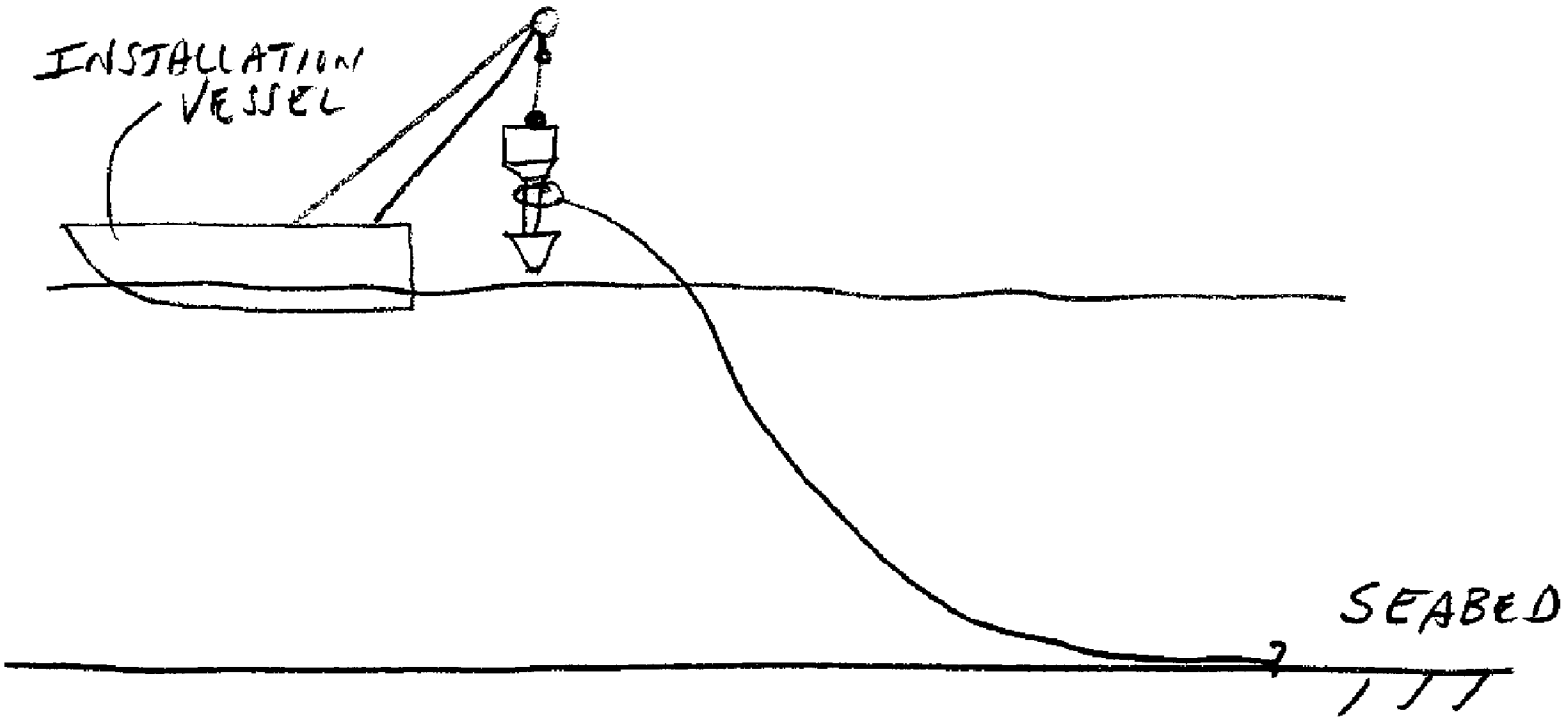
FIG. 17 shows an alternate embodiment of the present invention, where the gravity installed anchor is released from a position above the water surface.

Another method of deploying gravity installed anchor 10 (see FIG. 17) releases same from the installation vessel, without necessarily lowering the anchor into the water column; that is, the anchor may be held above the water surface, and released so as to fall to and into the water (and ultimately to the seabed), or may be (in essence) simply pushed off of the installation vessel to fall into and through the water.

SUMMARY

While the preceding description sets out specifics regarding certain embodiments of a apparatus and methods of installing and retrieving gravity installed anchors embodying the concepts of the disclosed invention, it is understood that other embodiments are possible without departing from the scope of the invention. For example, different types of gravity installed anchors could be used; any number of gravity installed anchors could be pre-set in a defined pattern, awaiting a structure to be moved into place; different manners of releasing the gravity installed anchor so that it may free-fall may be used; different manners of connecting to the deployment/recovery line, so as to retrieve the gravity installed anchor, maybe employed; and other changes are possible, all within the scope of the invention.

Therefore, the scope of the invention is not limited to the specific embodiment(s) set out herein, but only by the appended claims and their legal equivalents.

We claim:

1. A method for installation of a gravity installed anchor and a mooring assembly, comprising the steps of:

a) providing a gravity installed anchor and mooring assembly comprising:
   a gravity installed anchor, and a means for connecting a line to said gravity installed anchor; and
   a line, one end of said line attached to said means for connecting a line to said gravity installed anchor;
b) positioning at least a part of said line on a seabed, substantially along a line between the location of a structure to be moored and a desired location of installation of said gravity installed anchor in a seabed;
c) positioning said gravity installed anchor vertically over a desired location on a seabed; and
d) releasing said gravity installed anchor to fall to said seabed.

2. The method of claim 1, wherein said line comprises a mooring line for said structure to be moored.

3. The method of claim 1, wherein said anchor further comprises a deployment/recovery line attached thereto of sufficient length to reach a surface of a body of water overlying said seabed.

4. The method of claim 1, wherein said gravity installed anchor is released from a position above the surface of a body of water overlying said seabed.

5. A method for installation of a gravity installed anchor and a mooring assembly, comprising the steps of:

a) providing a gravity installed anchor and mooring assembly comprising:
   a gravity installed anchor, and a means for connecting a load line to said gravity installed anchor;
   a load line, one end of said load line attached to said means for connecting a load line to said gravity installed anchor; and
   a subsea connector attached to the other end of said load line;
b) lowering said gravity installed anchor and mooring assembly from an installation vessel, through a body of water over said seabed;
c) placing said subsea connector at a desired location on said seabed;
d) positioning said gravity installed anchor vertically over a desired location on a seabed, at a desired height above said seabed, thereby positioning said load line substantially along a line between said gravity installed anchor and the location of a structure to be moored; and
e) releasing said gravity installed anchor, whereby said gravity installed anchor falls to and penetrates into said seabed.

6. The method of claim 5, wherein said means for connecting a load line to said gravity installed anchor comprises a load arm connected to said gravity installed anchor and extending outwardly from a longitudinal axis of said gravity installed anchor.

7. The method of claim 5, wherein said means for connecting a load line to said gravity installed anchor comprises a shank forming a part of said gravity installed anchor.

8. The method of claim 5, wherein said means for connecting a load line to said gravity installed anchor comprises a load ring connected to said gravity installed anchor.

9. The method of claim 5, wherein said means for connecting a load line to said gravity installed anchor comprises a shackle.

10. The method of claim 5, wherein said means for connecting a load line to said gravity installed anchor comprises a side attachment.

11. The method of claim 5, wherein said means for connecting a load line to said gravity installed anchor comprises an end attachment.

12. The method of claim 5, further comprising the steps of:

f) providing a mooring line attached to a structure to be moored, said mooring line having a subsea connector attached thereto; and
g) connecting said subsea connector on said mooring line to said subsea connector on said load line.

13. The method of claim 5, wherein said step of positioning said gravity installed anchor vertically over a desired location on a seabed aligns said load line directionally along a line between said gravity installed anchor and a structure to be moored.

14. The method of claim 5, wherein said step of positioning said gravity installed anchor over a desired location on a seabed aligns said load line and said means for connecting said load line to said gravity installed anchor directionally along a line between said gravity installed anchor and a structure to be moored.

15. A method for installation of gravity installed anchors and mooring assemblies, and connecting a structure thereto, comprising the steps of:

a) providing an anchor and mooring assembly comprising:
   a gravity installed anchor having a longitudinal axis, and;
   a load line, one end of said load line attached to a means for connecting said load line to said gravity installed anchor;
   a subsea connector attached to the other end of said load line; and
   a means for holding said subsea connector in a desired position in relation to said seabed;
b) lowering said gravity installed anchor and mooring assembly from an installation vessel, through a body of water over said seabed;
c) placing said subsea connector and said means for holding said subsea connector in a desired position in relation to said seabed, at a desired location on said seabed;
d) moving said gravity installed anchor such that said load line and said means for connecting a load line to said gravity installed anchor are substantially aligned with a line between said gravity installed anchor and the location of a structure to be moored, and while said load line is so aligned, positioning said gravity installed anchor vertically over a desired location on a seabed, at a desired height above said seabed; and
e) releasing said gravity installed anchor, whereby said gravity installed anchor drops to and penetrates into said seabed.

16. The method of claim 15, wherein said means for connecting a load line to said gravity installed anchor comprises a load arm connected to said gravity installed anchor and extending outwardly from said longitudinal axis of said gravity installed anchor, said load arm connected so as to be capable of rotating around said longitudinal axis.

17. The method of claim 15, wherein said means for connecting a load line to said gravity installed anchor comprises a shank forming a part of said gravity installed anchor.

18. The method of claim 15, wherein said means for connecting a load line to said gravity installed anchor comprises a load ring connected to said gravity installed anchor.

19. The method of claim 15, wherein said means for connecting a load line to said gravity installed anchor comprises a shackle.

20. The method of claim 15, wherein said means for connecting a load line to said gravity installed anchor comprises a side attachment.

21. The method of claim 15, wherein said means for connecting a load line to said gravity installed anchor comprises an end attachment.

22. The method of claim 15, further comprising the steps of:

f) providing a mooring line attached to a structure to be moored, said mooring line having a subsea connector attached thereto; and g) connecting said subsea connector on said mooring line to said subsea connector on said load line.

23. The method of claim 22, further comprising the steps of:

h) providing a deployment/recovery line attached to an upper end of said gravity installed anchor, said deployment/recovery line having markings along its length;

I) after said gravity installed anchor has penetrated into said seabed, determining the depth of penetration of said anchor into said seabed by visually inspecting said markings.

24. The method of claim 23, further comprising the steps of:

j) disconnecting said subsea connector on said mooring line and said subsea connector on said subsea connector;

k) retrieving said gravity installed anchor from its embedment in said sea bed by pulling on said deployment/recovery line.

* * * * *